US007859466B2

(12) United States Patent
Mei

(10) Patent No.: US 7,859,466 B2
(45) Date of Patent: Dec. 28, 2010

(54) DUAL-BAND ANTENNA

(75) Inventor: Chia-Hao Mei, Taipei Hsien (TW)

(73) Assignee: Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 960 days.

(21) Appl. No.: 11/684,639

(22) Filed: Mar. 12, 2007

(65) Prior Publication Data

US 2008/0122700 A1 May 29, 2008

(30) Foreign Application Priority Data

Nov. 24, 2006 (CN) ..... 2006 1 0157057

(51) Int. Cl.
*H01Q 1/38* (2006.01)

(52) U.S. Cl. ..... 343/700 MS; 343/848

(58) Field of Classification Search ..... 343/700 MS, 343/702, 848

See application file for complete search history.

(56) References Cited

U.S. PATENT DOCUMENTS

| | | | | |
|---|---|---|---|---|
| 6,337,663 | B1 | 1/2002 | Chi-Ming | |
| 6,856,285 | B2 * | 2/2005 | Bettin et al. | 343/700 MS |
| 6,992,631 | B2 * | 1/2006 | Lu | 343/700 MS |
| 7,385,556 | B2 * | 6/2008 | Chung et al. | 343/700 MS |
| 7,573,424 | B2 * | 8/2009 | Mei | 343/700 MS |
| 2008/0024366 | A1 * | 1/2008 | Cheng | 343/700 MS |

FOREIGN PATENT DOCUMENTS

| | | |
|---|---|---|
| TW | 557608 | 10/2003 |
| TW | I223470 | 11/2004 |

OTHER PUBLICATIONS

H.S.Choi et al., Ultra-compact CPW-fed Monopole Antenna with Double Inverted-L Strips for Dual-Band WLAN Applications, IEEE Trans. Antennas Propagat., vol. 52, pp. 978-982, Apr. 2004.

* cited by examiner

*Primary Examiner*—Tan Ho
(74) *Attorney, Agent, or Firm*—Wei Te Chung

(57) ABSTRACT

A dual-band antenna (10) is disposed on a substrate (20), for transceiving electromagnetic signals of different frequencies. The dual-band antenna includes a grounded portion (12), a feeding portion (14), and a radiation body (16). The feeding portion is adjacent to the grounded portion. The radiation body electronically connected to the feeding portion, includes a first radiation portion (160) and a second radiation portion (162). The first radiation portion includes a first free end (160*c*), a first connecting end (160*a*) electronically connected to the feeding portion, and a serpentine portion (160*b*) between the first free end and the first connecting end. The second radiation portion, includes a second connecting end (162*a*) electronically connected to the first connecting end, and a second free end (162*b*), wherein the first free end and the second free end face each other and a gap (18) is formed therebetween.

15 Claims, 8 Drawing Sheets

DUAL-BAND ANTENNA

BACKGROUND

1. Field of the Invention

The present invention relates to antennas, and particularly to a dual-band antenna.

2. Related Art

Antennas are necessary components for wireless communication system devices, such as wireless access points, mobile stations, etc. The antennas on the WLAN devices mainly operate with two frequencies: one is 2.4 GHz, and the other is 5.0 GHz, which comply with the Institute of Electrical and Electronics Engineers (IEEE) 802.11 standard. Generally, many antennas configured in the WLAN devices may increase the size and total manufacturing cost of the WLAN devices.

Therefore, a heretofore unaddressed need exists in the industry to overcome the aforementioned deficiencies and inadequacies.

SUMMARY

One aspect of the present invention provides a dual-band antenna. The dual-band antenna is disposed on a substrate, for transceiving electromagnetic signals of different frequencies. The dual-band antenna includes a grounded portion, a feeding portion, and a radiation body. The feeding portion is adjacent to the grounded portion. The radiation body electronically connected to the feeding portion includes a first radiation portion and a second radiation portion. The first radiation portion includes a first free end, a first connecting end electronically connected to the feeding portion, and a serpentine portion between the first free end and the first connecting end. The second radiation portion includes a second connecting end electronically connected to the first connecting end, and a second free end, wherein the first free end and the second free end face each other and a gap is formed therebetween.

Other objectives, advantages and novel features of the present invention will be drawn from the following detailed description of preferred embodiments of the present invention with the attached drawings, in which:

DETAILED DESCRIPTION OF THE EMBODIMENTS

Figure 1:
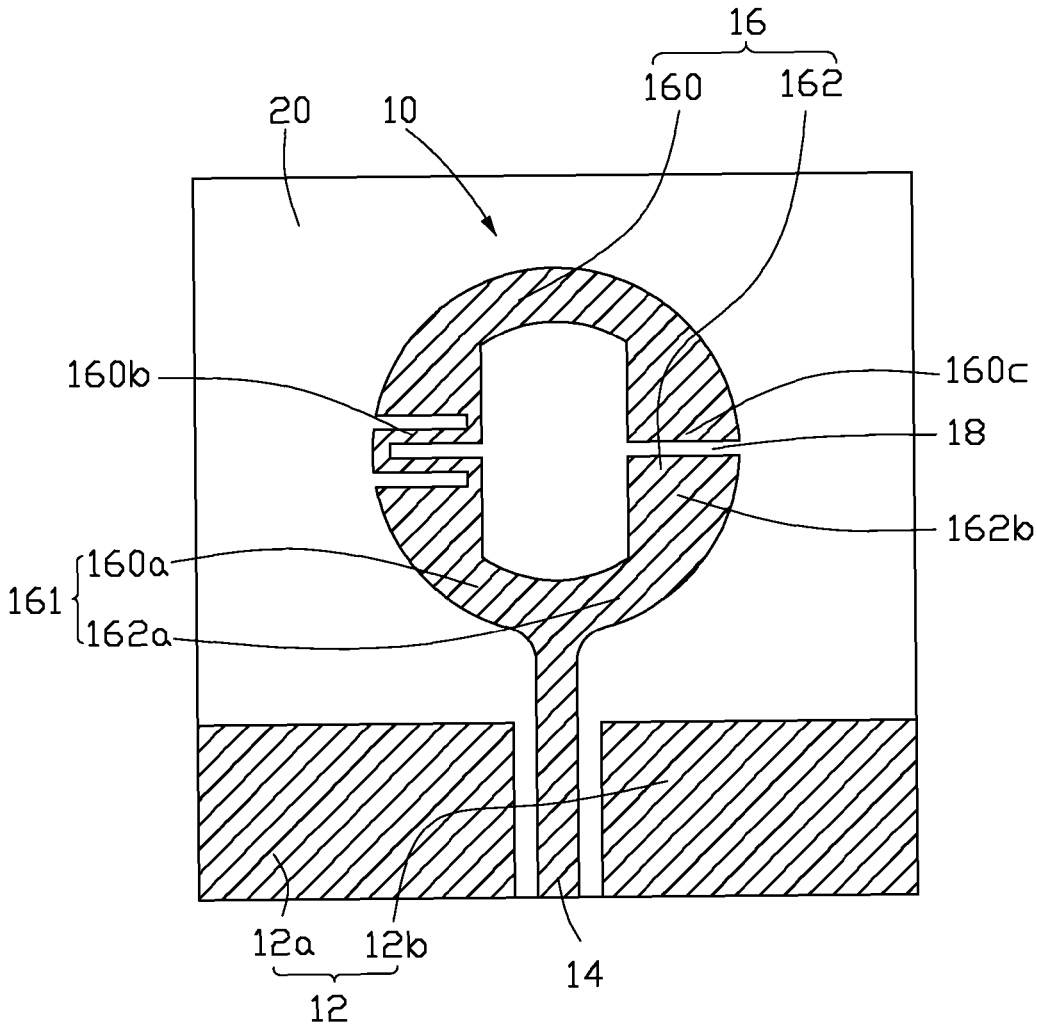
FIG. 1 is a schematic diagram of a dual-band antenna in accordance with an exemplary embodiment of the invention.

FIG. 1 is a schematic diagram of a dual-band antenna 10 in accordance with an exemplary embodiment of the invention.

In the exemplary embodiment, the dual-band antenna 10 is disposed on a substrate 20, for transceiving electromagnetic signals of different frequencies. The dual-band antenna 10 includes a grounded portion 12, a feeding portion 14, and a radiation body 16. The feeding portion 14 is adjacent to the grounded portion 12, and is used for feeding signals. The feeding portion 14 is configured to provide a matching impedance. In the exemplary embodiment the matching impedance of the feeding portion of the dual-band antenna 10 is 50 ohms.

In the exemplary embodiment, the radiation body 16 is ring-shaped with a central hole formed therein. Two opposite circumambient sides of the central hole extend straightly while the other two opposite circumambient side of the central hole extend curvilinearly. The radiation body 16 includes a first radiation portion 160 and a second radiation portion 162.

The first radiation portion 160 operates at a first frequency of 2.4 GHz. The first radiation portion 160 includes a first free end 160*c*, a first connecting end 160*a* electronically connected to the feeding portion 14, and a serpentine portion 160*b* configured between the first free end 160*c* and the first connecting end 160*a*. The second radiation portion 162 operates at a second frequency of 5 GHz. The second radiation portion 162 includes a second connecting end 162*a* electronically connected to the first connecting end 160*a*, and a second free end, wherein the first free end 160*c* and the second free end 162*b* face each other and a gap 18 is formed therebetween. The first radiation portion 160 and the second radiation portion 162 are integrally formed as a single piece. A length of the first radiation portion 160 is greater than that of the second radiation portion 162.

In the exemplary embodiment, the serpentine portion 160*b* can reduce the rectilinear length of the first radiation portion 160 yet still allow the first radiation portion 160 to keep resonating. A radiation effect produced by a coupling effect of the serpentine portion 160*b* can improve the radiation efficiency of the dual-band antenna 10. In this embodiment, the serpentine portion 160*b* is concertinaed. In other embodiments, the serpentine portion 160*b* has a selected one of a w-shaped configuration, an s-shaped configuration, and a unshaped configuration.

The grounded portion 12 includes a first grounded block 12*a* and a second grounded block 12*b*. The first grounded block 12*a* is disposed on one side of the feeding portion 14, and the second grounded block 12*b* is disposed on the other side of the feeding portion 14.

In the exemplary embodiment, the first free end 160*c* and the second free end 162*b* cooperatively define a capacitive load, and the capacitive load can produce an electromagnetic field effect. The electromagnetic field effect can be shared by the first radiation portion 160 and the second radiation portion 162, so that lengths of the first radiation portion 160 and the second radiation portion 162 can be effectively reduced. Therefore, the area of the radiation body 16 is effectively reduced.

The gap 18 is disposed on one side of the radiation body 16. The serpentine portion 160*b* is disposed on an opposite side to the gap 18. The first connecting end 160*a* and the second connecting end 162*a* co-form a connecting end 161. The connecting end 161 between the gap 18 and the serpentine portion 160*b* is electronically connected to the feeding portion 14.

Figure 2:
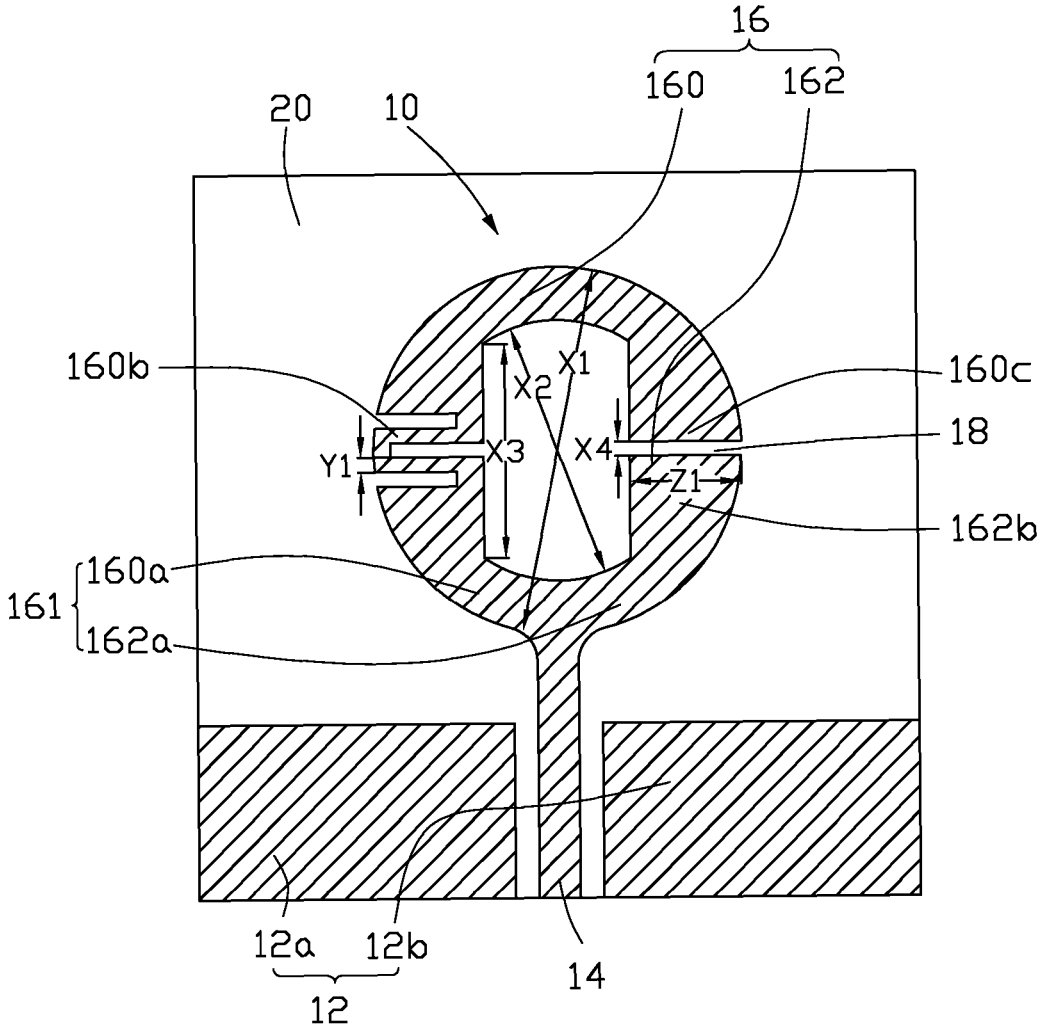
FIG. 2 is a schematic diagram illustrating dimensions of the dual-band antenna of FIG. 1.

FIG. 2 is a schematic diagram illustrating dimensions of the dual-band antenna 10 of FIG. 1. In this embodiment, an outside radius X1 of the radiation body 16 is 10 mm, and an inside radius X2 of the radiation body 16 is 6 mm. A length X3 of a straight inside edge connecting two arced inside edges of the radiation body 16 is 5 mm. A width X4 of the gap 18 is 0.5 mm. A width Z1 of the second free end 162*b* is 3.3 mm.

Figure 3:
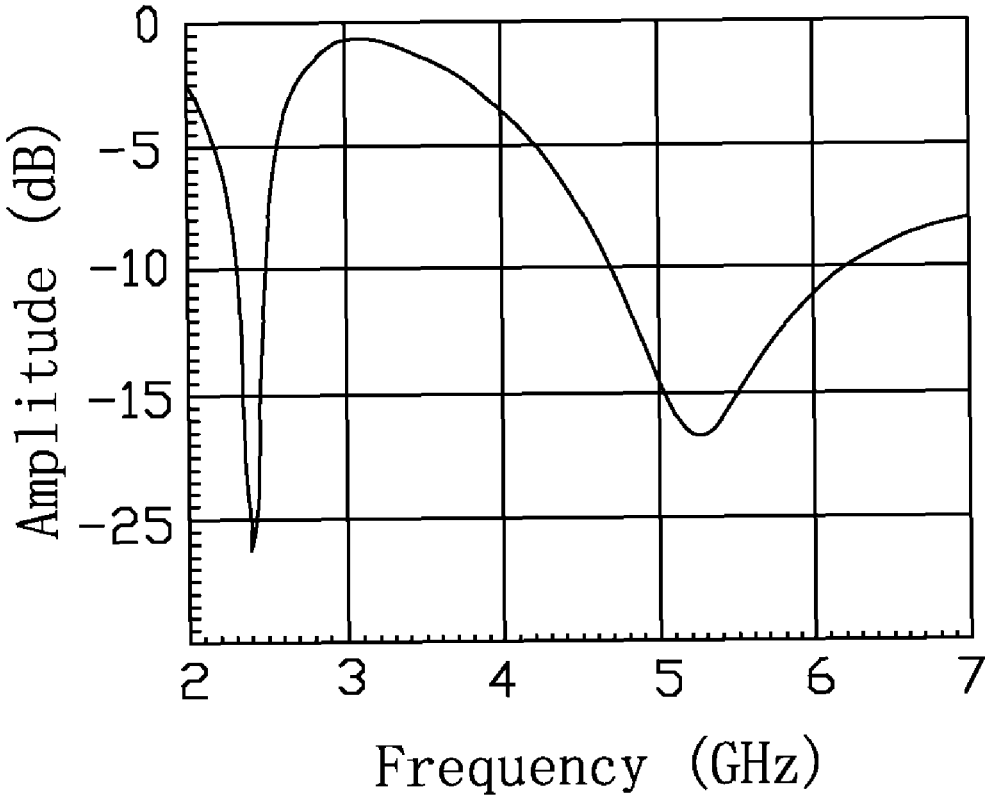
FIG. 3 is a graph of test results showing a return loss of the dual-band antenna of FIG. 1.
Figure 4:
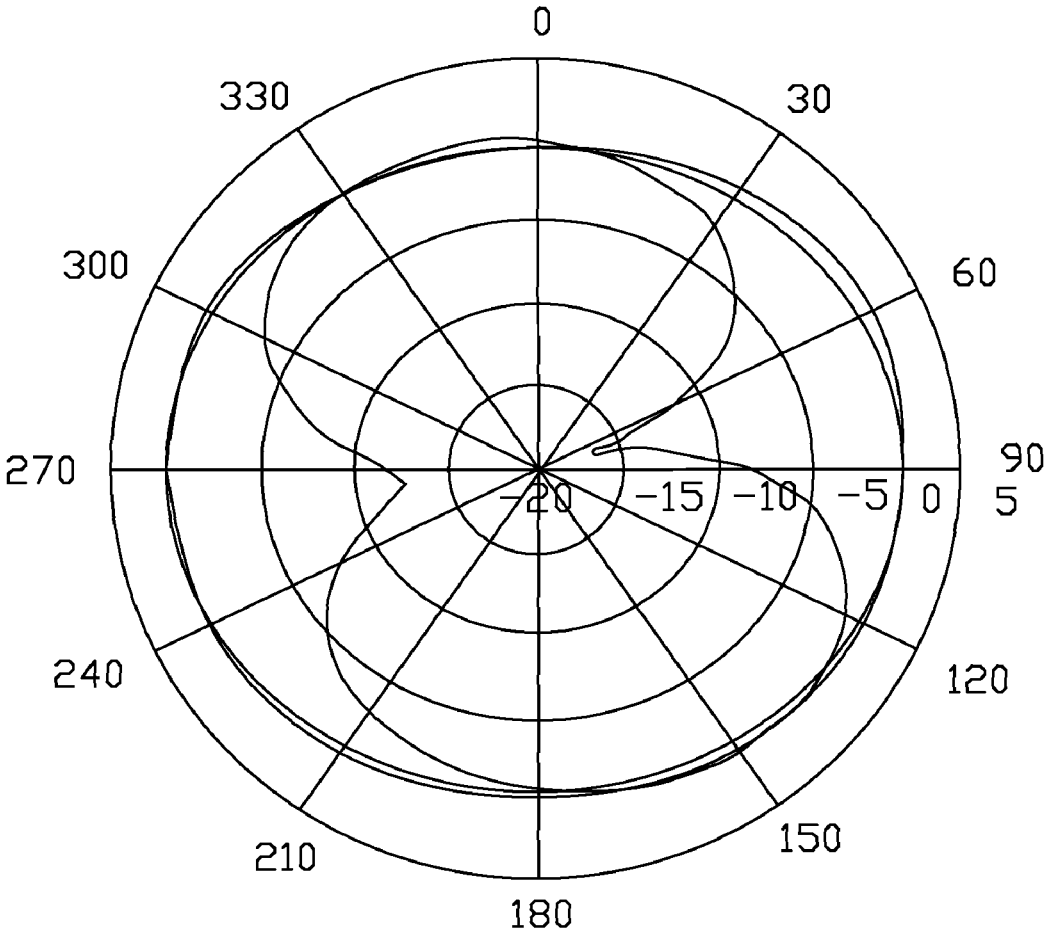
FIG. 4 is a graph of test results showing a YZ plane horizontal polarization radiation pattern when the dual-band antenna of FIG. 1 operates at 2.4 GHz.
Figure 5:
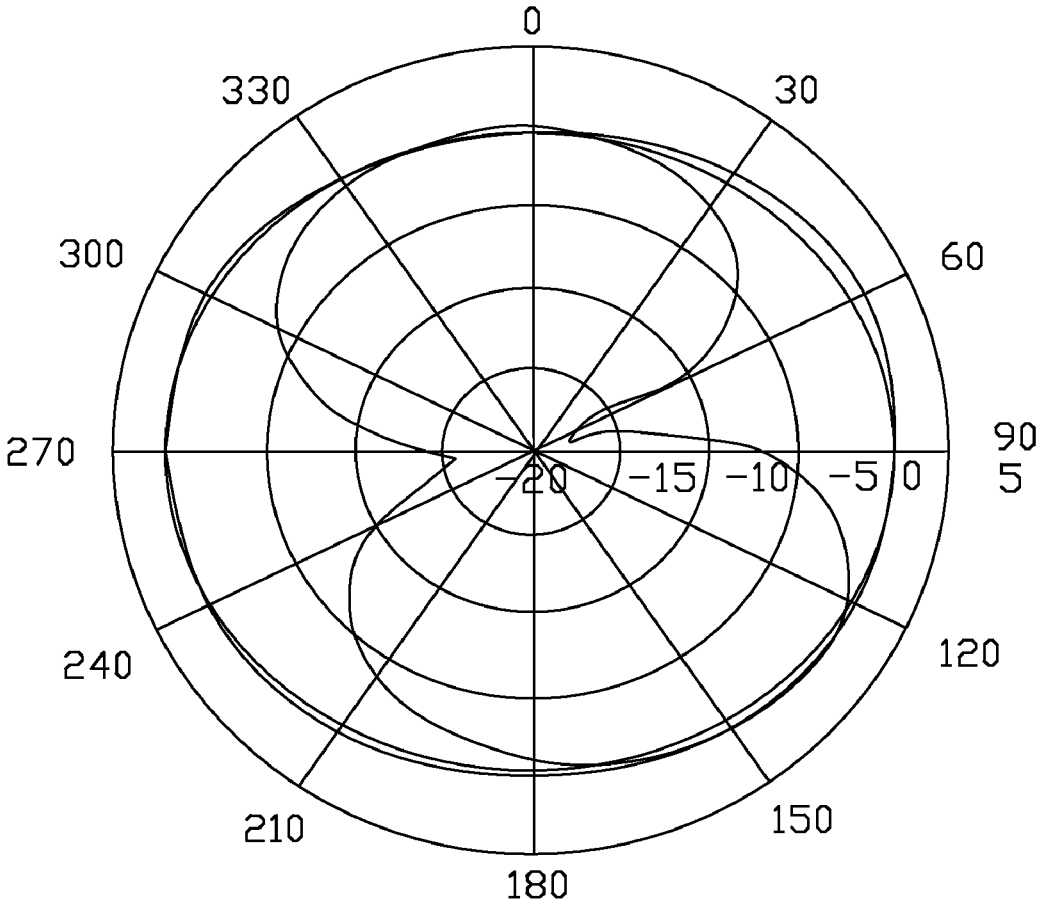
FIG. 5 is a graph of test results showing a YZ plane horizontal polarization radiation pattern when the dual-band antenna of FIG. 1 operates at 2.5 GHz.
Figure 6:
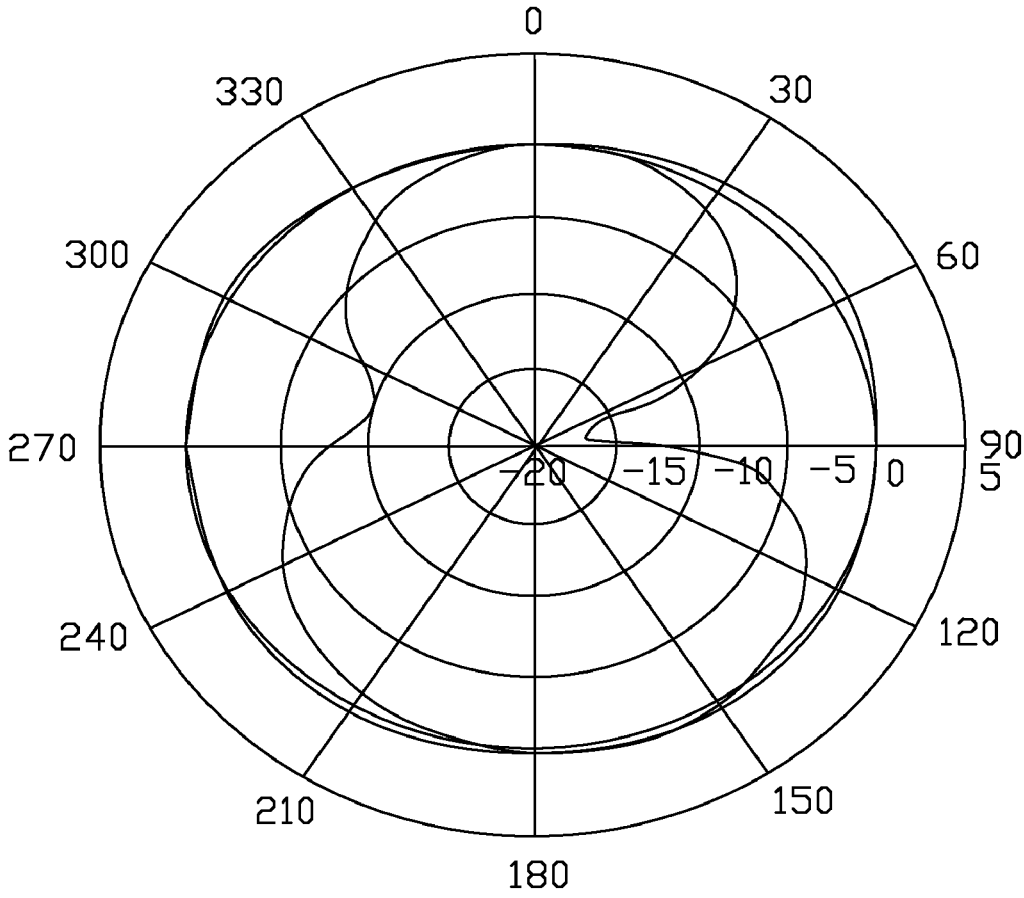
FIG. 6 is a graph of test results showing a YZ plane horizontal polarization radiation pattern when the dual-band antenna of FIG. 1 operates at 5.0 GHz.
Figure 7:
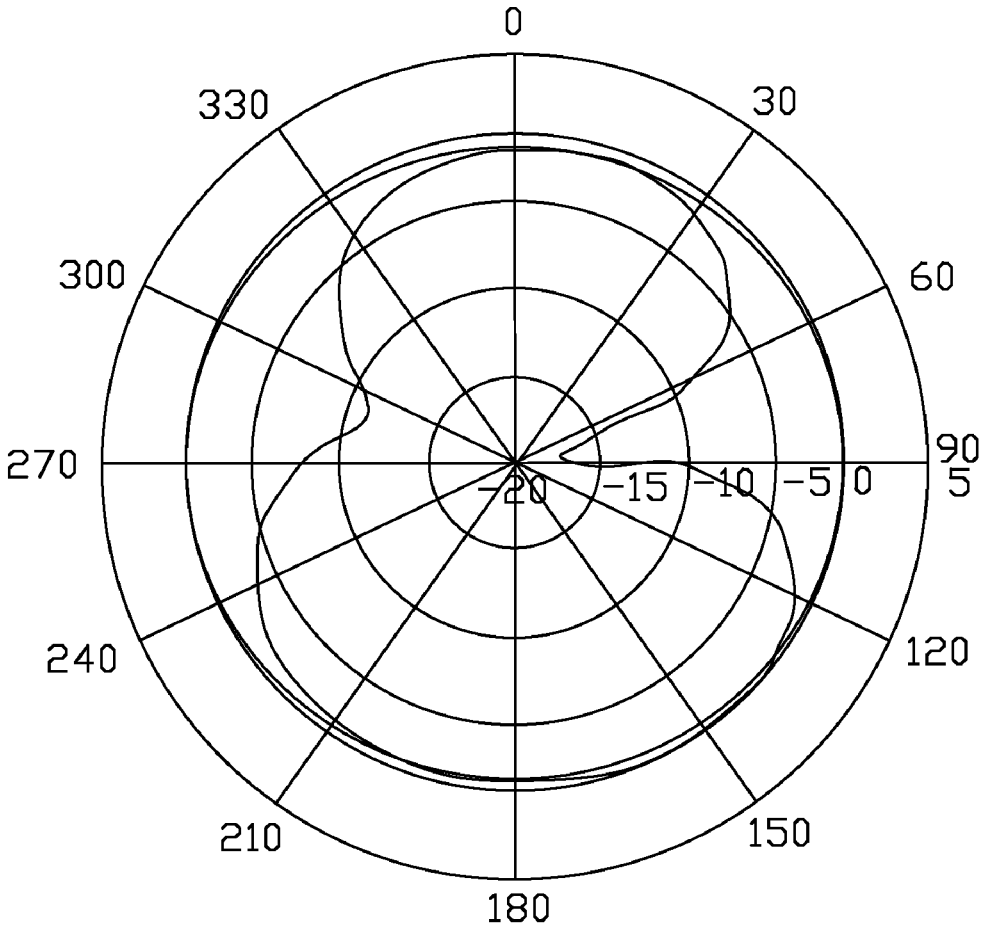
FIG. 7 is a graph of test results showing a YZ plane horizontal polarization radiation pattern when the dual-band antenna of FIG. 1 operates at 5.5 GHz.
Figure 8:
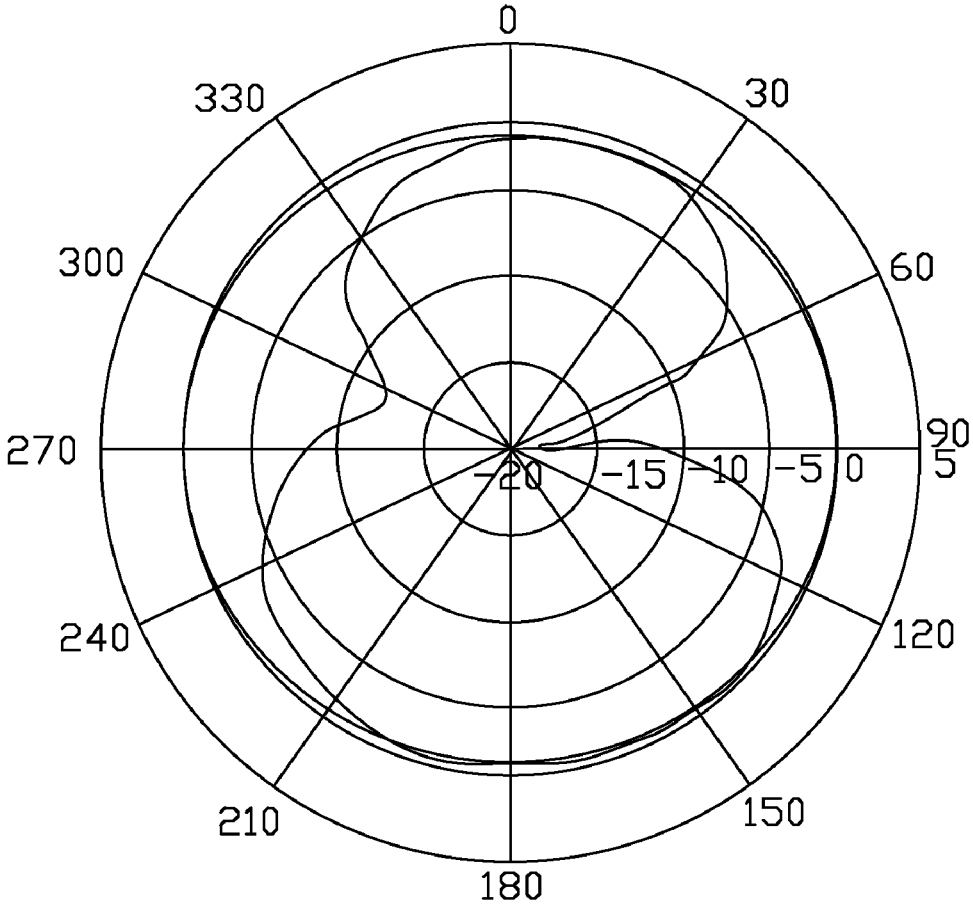
FIG. 8 is a graph of test results showing a YZ plane horizontal polarization radiation pattern when the dual-band antenna of FIG. 1 operates at 6.0 GHz.

FIG. 3 is a graph of test results showing a return loss of the dual-band antenna 10. A horizontal axis represents the frequency (in GHz) of the electromagnetic signals traveling through the dual-band antenna 10, a vertical axis represents the amplitude of return loss (in dB) of the dual-band antenna 10, and a curve represents the return loss of the dual-band antenna 10. As shown in FIG. 3, the dual-band antenna 10 has a good performance when respectively operating at frequencies of 2.4 GHz and 5.0 GHz. The amplitude values of the return loss in the band pass frequency range are smaller than −10 dB, which indicates that the dual-band antenna 10 complies with application of WLAN devices.

FIGS. 4-8 show radiation patterns when the dual-band antenna 10 respectively operates at 2.4 GHz, 2.5 GHz, 5.0 GHz, 5.5 GHz, and 6.0 GHz. As shown, all of the radiation patterns are substantially omni-directional.

In other embodiments, the second radiation portion 162 may include a serpentine portion, and the area of the dual-band antenna 10 can be further reduced. However, the length of the second radiation portion 162 should be smaller than that of the first radiation portion 160. The dual-band antenna 10 not only operates at frequencies of 2.4 GHz and 5.0 GHz. When the size and/or shape of the dual-band antenna 10 is changed or configured appropriately, the dual-band antenna 10 can function according to other various desired communication standards or ranges.

The description of the present invention has been presented for purposes of illustration and description, and is not intended to be exhaustive or limited to the invention in the form disclosed. Many modifications and variations will be apparent to those of ordinary skill in the art. The embodiment was chosen and described in order to best explain the principles of the invention, the practical application, and to enable others of ordinary skill in the art to understand the invention for various embodiments with various modifications as are suited to the particular use contemplated.

What is claimed is:

1. A dual-band antenna disposed on a substrate for transceiving electromagnetic signals of different frequencies, comprising:

a grounded portion;

a feeding portion adjacent to the grounded portion, for feeding signals; and a radiation body electronically connected to the feeding portion, comprising:

a first radiation portion, comprising a first free end, a first connecting end electronically connected to the feeding portion, and a serpentine portion between the first free end and the first connecting end; and a second radiation portion, comprising a second connecting end electronically connected to the first connecting end, and a second free end, wherein the first free end and the second free end face each other and a gap is formed therebetween;

wherein the first radiation portion and the second radiation portion collectively define a hole at a center of the radiation body, two opposite circumambient sides of the hole extending straightly while the rest circumambient sides of the hole extending curvilinearly.

2. The dual-band antenna as recited in claim 1, wherein a length of the first radiation portion is greater than that of the second radiation portion.

3. The dual-band antenna as recited in claim 1, wherein the first radiation portion and the second radiation portion are integrally formed.

4. The dual-band antenna as recited in claim 1, wherein the grounded portion comprises a first grounded block and a second grounded block, the first grounded block is disposed on one side of the feeding portion, and the second grounded block is disposed on the other side of the feeding portion.

5. The dual-band antenna as recited in claim 1, wherein the radiation body is ring-shaped.

6. The dual-band antenna as recited in claim 1, wherein the first free end and the second free end co-define a capacitive load.

7. The dual-band antenna as recited in claim 1, wherein the serpentine portion has a selected one of a w-shaped configuration, an s-shaped configuration, and a u-shaped configuration.

8. A dual-band antenna, disposed on a substrate, for transceiving electromagnetic signals of different frequencies, comprising:

a grounded portion;

a feeding portion, disposed beside the grounded portion; and a radiation body, substantially ring-shaped with a hole being defined at a center thereof, the radiation body defining a gap on one side thereof, and comprising a serpentine portion on an opposite side to the gap, and a connecting end disposed between the gap and the serpentine portion and electronically connected to the feeding portion;

wherein two opposite circumambient sides of the hole extend straightly while the rest circumambient sides of the hole extend curvilinearly.

9. The dual-band antenna as recited in claim 8, wherein the grounded portion comprises a first grounded block and a second grounded block, the first grounded block is disposed on one side of the feeding portion, and the second grounded block is disposed on the other side of the feeding portion.

10. The dual-band antenna as recited in claim 8, wherein the serpentine portion has a selective one of a w-shaped configuration, an s-shaped configuration, and a u-shaped configuration.

11. The dual-band antenna as recited in claim 8, wherein an outside radius and an inside radius of the radiation portion are respectively 10 mm and 6 mm.

12. The dual-band antenna as recited in claim 11, wherein a length of a straight edge co-formed by the serpentine portion and the inside ring to connect two inside arced edges thereof is 5 mm.

13. An antenna assembly comprising:

a substrate; and an antenna attachably formed on said substrate for transceiving electromagnetic signals of different frequencies, said antenna comprising a feeding portion for feeding signals of said antenna, and a radiation body electrically connectable with said feeding portion for radiating said signals of said antenna, a hole defined at a center of said radiation body and two opposite circumambient sides of said hole extending straightly while the rest circumambient sides of said hole extend curvilinearly, a gap defined in said radiation body beside said hole and configured to end at one of said two opposite straightly extending circumambient sides of said hole.

14. The antenna assembly as recited in claim 13, wherein said radiation body is circular ring-shaped.

15. The antenna assembly as recited in claim 13, wherein a serpentine portion is defined in said radiation body beside said hole and configured to neighbor the other of said two opposite straightly extending circumambient sides of said hole.

* * * * *